US007753295B1

(12) United States Patent
Lo

(10) Patent No.: US 7,753,295 B1
(45) Date of Patent: Jul. 13, 2010

(54) PAPER SHREDDER WHICH PREVENTS CUTTING FINGERS

(76) Inventor: Emily Lo, No. 18, 20 Lane, Hsin Feng Street, Hsin Chuang City, Taipei Shien (TW)

( * ) Notice: Subject to any disclaimer, the term of this patent is extended or adjusted under 35 U.S.C. 154(b) by 0 days.

(21) Appl. No.: 12/401,576

(22) Filed: Mar. 10, 2009

Related U.S. Application Data

(63) Continuation-in-part of application No. 11/895,787, filed on Aug. 27, 2007, now abandoned.

(51) Int. Cl.
*B02C 23/04* (2006.01)

(52) U.S. Cl. ..... 241/37.5

(58) Field of Classification Search ..... 241/100, 241/236, 295, 37.5
See application file for complete search history.

(56) References Cited

U.S. PATENT DOCUMENTS 4,982,907 A * 1/1991 Sedgwick et al. ..... 241/236
5,400,978 A * 3/1995 Strohmeyer ..... 241/166
5,511,732 A * 4/1996 Kroger et al. ..... 241/166
7,007,878 B2 * 3/2006 Strong ..... 241/236
2004/0262436 A1 * 12/2004 Lo ..... 241/236

* cited by examiner

*Primary Examiner*—Faye Francis
(74) *Attorney, Agent, or Firm*—Pro-Techtor Int'l Services; Ralph Willgohs

(57) ABSTRACT

A paper shredder which prevents cutting fingers is composed of a plurality of stops at two sides of a slot hole of a rack of two blade tools inside the paper shredder. The stops, which are aligned in alternation, are emplaced respectively between two blades. When a paper drop opening at a bottom cap is aligned with the slot hole of the rack, the stops will limit space the paper drop opening extending into the blade tool, which prevents from inserting fingers into the paper drop opening to be cut by the blade tool, and also prevents from putting in extraneous material to cause malfunction of the paper shredder.

2 Claims, 3 Drawing Sheets

PAPER SHREDDER WHICH PREVENTS CUTTING FINGERS

CROSS-REFERENCES TO RELATED APPLICATIONS

This is a continuation-in-part of U.S. patent application Ser. No. 11/895,787, filed on Aug. 27, 2007 and now abandoned, incorporated by reference into this specification.

BACKGROUND OF THE INVENTION a) Field of the Invention

The present invention relates to a paper shredder, and more particularly to a paper shredder, wherein a blade tool rack in a paper drop opening of which is installed with a plurality of stops to cover a part of the paper drop opening, so as to prevent fingers from being cut by inserting into the paper drop opening.

b) Description of the Prior Art

A paper drop opening at a bottom of an ordinary paper shredder allows paper chips which are shredded by cutting blades to drop into a bin. As a blade tool rack in the paper drop opening is not provided with stops, children often put there fingers or thin objects into the paper drop opening from curiosity, which can hurt the fingers and also cause malfunction of the paper shredder.

SUMMARY OF THE INVENTION

Accordingly, the primary object or the present invention is to provide a paper shredder, a blade tool rack in a paper drop opening of which is installed with a plurality of stops, with the stops being able to prevent children from putting fingers into the blade tool to get hurt, and also to prevent children from putting thin objects into the paper drop opening to cause malfunction of the paper shredder.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
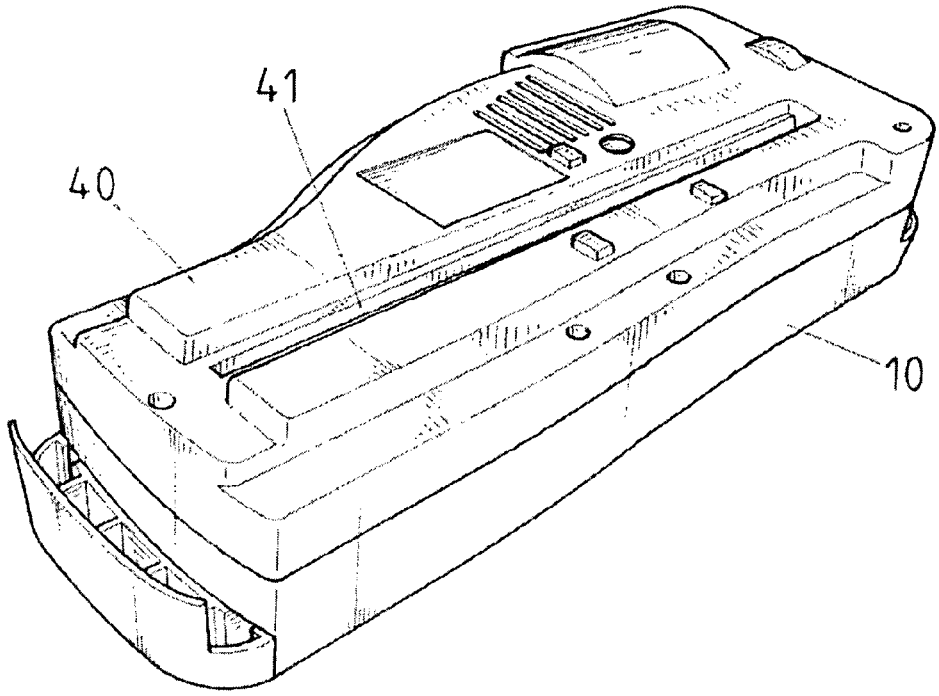
FIG. 1 shows a bottom perspective view according to the present invention.
Figure 2:
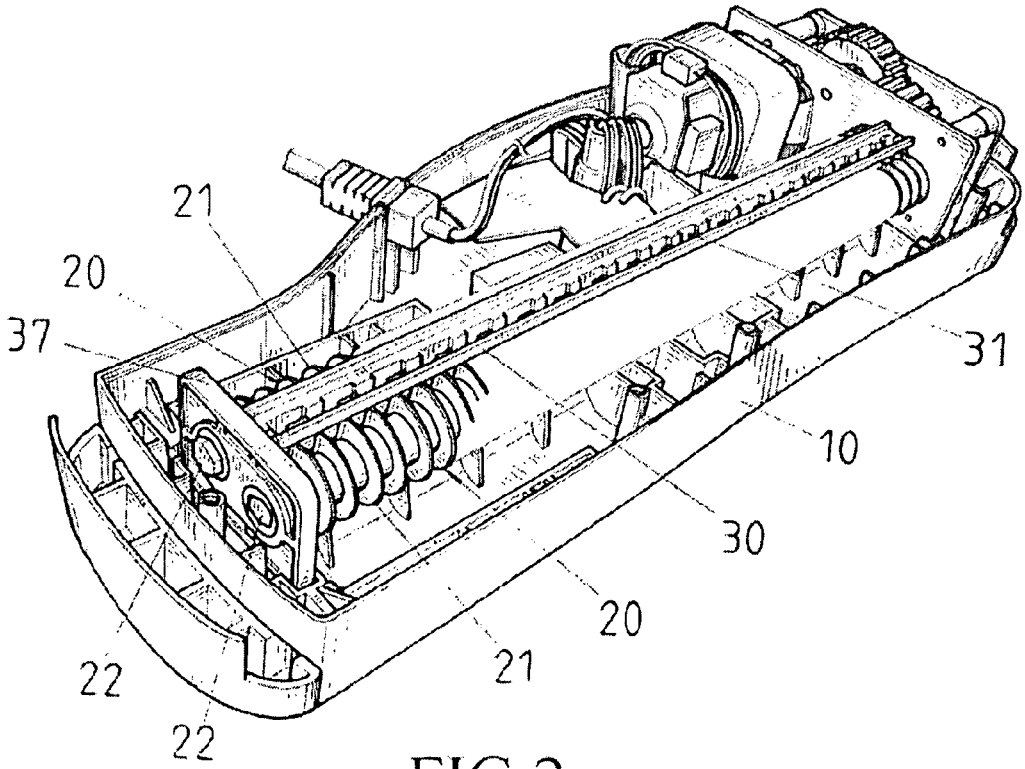
FIG. 2 shows a bottom exploded view according to the present invention.
Figure 3:
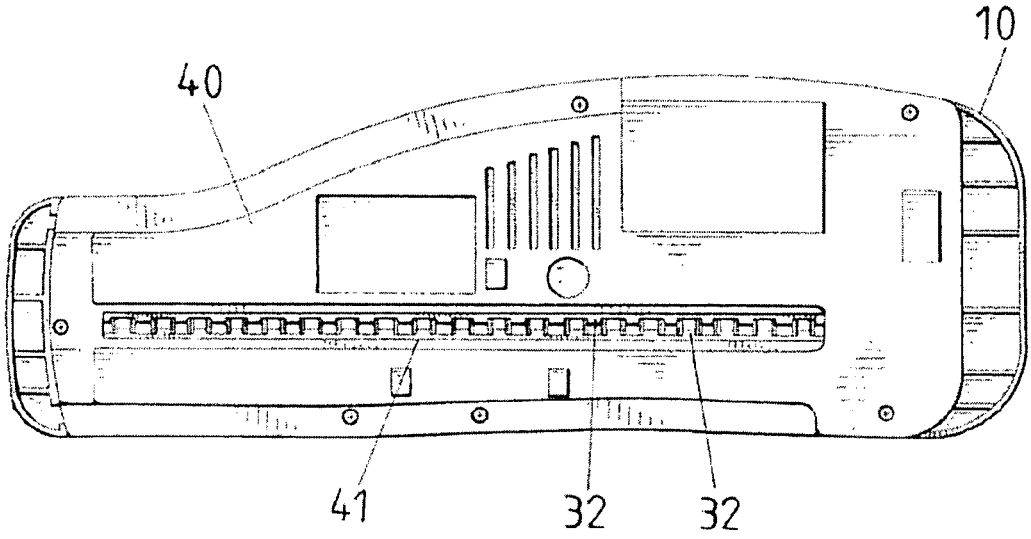
FIG. 3 shows a bottom plan view according to the present invention.

Referring to FIGS. 1 to 3, on two oppositely facing racks 30, between two counter-rotating blade tools 20, with spaced interleaving blades 21 in an interior of a bottom casing 10 of the present invention is a long slot hole 31 which aligns with a long paper drop opening 41 at a bottom cap 40; whereas, paper chips which are shredded by the blade tools 20 drop into a bottom bin through the slot hole 31 and the paper drop opening 41.

Figure 4:
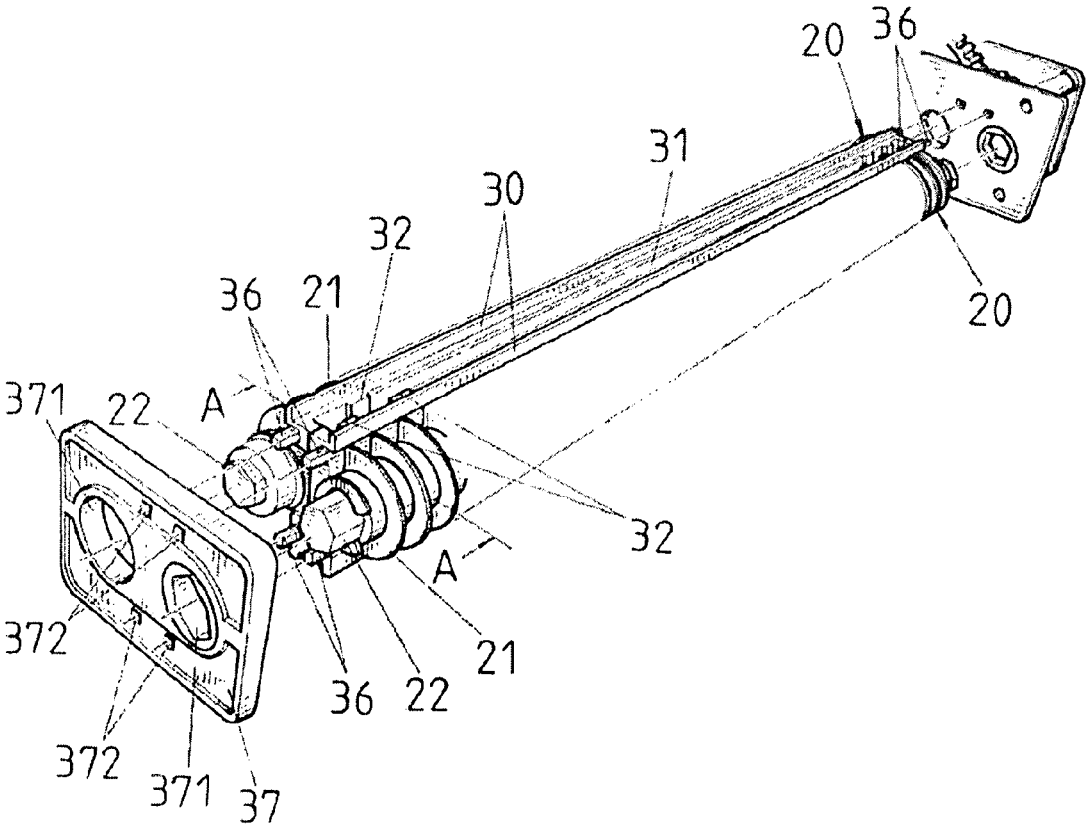
FIG. 4 shows an exploded view of two blade tools and a rack according to the present invention.
Figure 5:
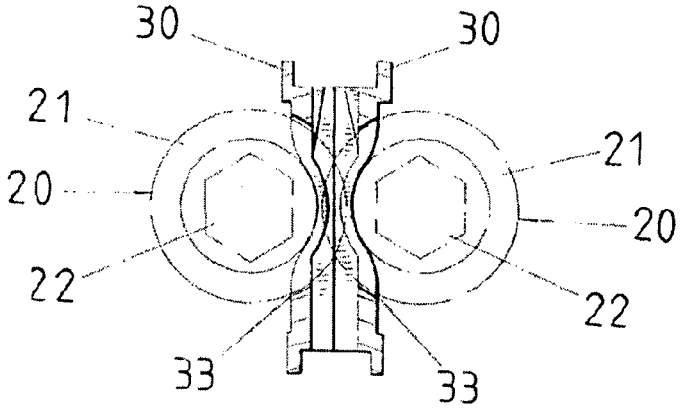
FIG. 5 shows a cross-sectional view of FIG. 4 according to the present invention.
Figure 6:
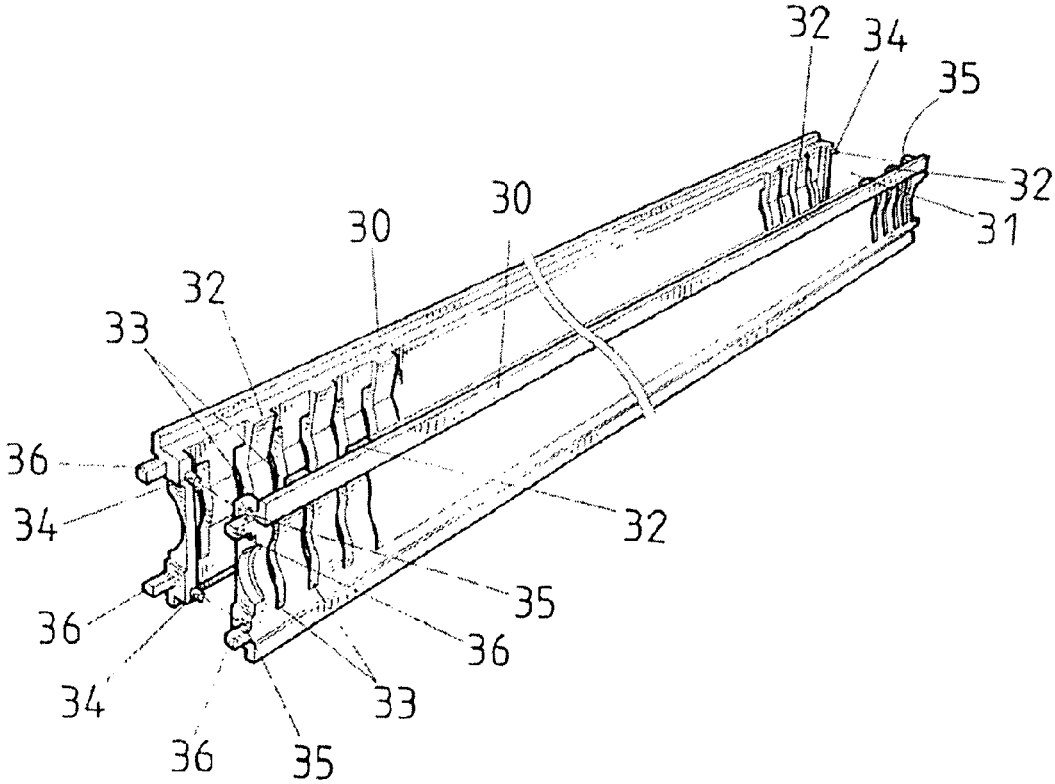
FIG. 6 shows a structural view of a rack according to the present invention.

The two oppositely facing racks 30 at two sides of the slot hole 31 are installed with a plurality of stops 32 which are separated with each other in alternation; a plurality of stops 32 positioned alternately on opposing lateral sides of the slot hole 31 and projecting into the slot hole 31, with each stop 32 located beneath a gap between neighboring blades 21 of a respective blade tool 20 and separate from the bottom casing 2; wherein the space through the paper drop opening 41 extending into the blade tools 20 is limited by the stops 32. Two sides of the stops 32 of the racks 30 are provided respectively with longitudinal slot 33 for transfixing with the blades 21 of the blade tools 20. The two racks 30 are assembled together by inserting pins 34 of one rack 30 into pin holes 35 of the other rack 30 (see FIG. 6), and a side of each rack 30 is provided with pillars 36. A position plate 37 is provided with two shaft holes 371 which can be sheathed on a shaft 22 of the blade tool 20 respectively (see FIGS. 4 and 5); whereas, pillar holes 372 on the position plate 37 provide for insertion of the pillars 36 of the racks 30. As the stops 32 of the racks 30 are arranged in alternation, space the paper drop opening 41 at the bottom cap 40 extending into the blade tool 20 will be limited, which can prevent children from putting in their fingers to get hurt, and can also prevent from inserting extraneous material in a shape of long strip into the blade tools 20 to cause malfunction of the paper shredder.

Accordingly, the present invention includes a paper shredder, a rack in a paper drop opening at a bottom cap of which is installed with stops that are aligned in alternation, which limits the space in the paper drop opening extending into a blade tool, thereby preventing from inserting fingers to get hurt or from putting in extraneous material to damage the paper shredder.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A paper shredder which prevents cutting fingers, comprising a bottom casing having two counter-rotating blade tools with spaced interleaving blades;

a paper drop opening aligned above the blades of the counter-rotating blade tools;

two oppositely facing racks;

a slot hole, between said racks, aligned with and positioned between the drop opening and the blades of the counter-rotating blade tools; and a plurality of stops positioned alternately on opposing lateral sides of the slot hole and projecting into the slot hole, with each stop located beneath a gap between neighboring blades of a respective blade tool and separate from a paper shredding head;

wherein a space through the paper drop opening extending into the blade tools is limited by the stops and wherein one rack on one side of the pair of racks is provided with pins, the other rack is provided with pin holes, and the two racks are assembled together by inserting the pins into the pin holes.

2. The paper shredder which prevents cutting fingers according to claim 1, wherein a side of each rack is provided with pillars, a position plate is provided at a side of the blade tool, two shaft holes of the position plate are sheathed respectively on shafts of the blade tool and pillar holes of the position plate provide for insertion of the pillars of the racks.

* * * * *